US009493968B2

(12) United States Patent
Fannon et al.

(10) Patent No.: US 9,493,968 B2
(45) Date of Patent: Nov. 15, 2016

(54) STRIKER WITH EXPANDABLE SLEEVE

(71) Applicant: GM GLOBAL TECHNOLOGY OPERATIONS LLC, Detroit, MI (US)

(72) Inventors: Joseph P. Fannon, Washington, MI (US); Derek L. Patterson, Shelby Township, MI (US); Hugh S. Bauer, Macomb Township, MI (US); Paulo M. Mendonca, São Paulo (BR)

(73) Assignee: GM Global Technology Operations LLC, Detroit, MI (US)

( * ) Notice: Subject to any disclaimer, the term of this patent is extended or adjusted under 35 U.S.C. 154(b) by 99 days.

(21) Appl. No.: 14/073,388

(22) Filed: Nov. 6, 2013

(65) Prior Publication Data

US 2014/0239653 A1 Aug. 28, 2014

Related U.S. Application Data

(60) Provisional application No. 61/768,867, filed on Feb. 25, 2013.

(51) Int. Cl.

| | |
|---|---|
| ***E05B 15/02*** | (2006.01) |
| ***E05B 85/04*** | (2014.01) |
| ***E05B 77/38*** | (2014.01) |

(52) U.S. Cl.

CPC ..... *E05B 85/045* (2013.01); *E05B 77/38* (2013.01); *Y10T 29/4987* (2015.01); *Y10T 29/49826* (2015.01); *Y10T 292/68* (2015.04)

(58) Field of Classification Search

CPC ..... E05B 15/02; E05B 15/022; E05B 15/023; E05B 15/0235; E05B 15/0295; E05B 15/0255; E05B 15/0205; E05B 77/38

USPC ..... 292/341, 341.11, 341.12, 341.13, 292/341.14, DIG. 19, DIG. 38, DIG. 53, 292/DIG. 56, DIG. 57, DIG. 58, DIG. 64, 340

See application file for complete search history.

(56) References Cited

U.S. PATENT DOCUMENTS

| | | | | |
|---|---|---|---|---|
| 2,987,336 | A * | 6/1961 | Kramer | 292/52 |
| 3,296,694 | A * | 1/1967 | De Mastry et al. | 29/520 |
| 3,350,128 | A * | 10/1967 | Martens | 292/341.12 |
| 3,572,797 | A * | 3/1971 | Shay | 292/341.12 |
| 3,591,225 | A * | 7/1971 | Hagemeyer | 292/340 |

(Continued)

FOREIGN PATENT DOCUMENTS

| | | | |
|---|---|---|---|
| CN | 102971473 | A | 3/2013 |
| FR | 2465054 | A1 | 3/1981 |
| WO | 0004259 | A2 | 1/2000 |

*Primary Examiner* — Alyson M Merlino

(74) *Attorney, Agent, or Firm* — Quinn Law Group, PLLC

(57) ABSTRACT

A striker assembly includes a striker having an attachment portion, a shaft portion having a cylindrical outer surface, and a shoulder portion between the shaft portion and the attachment portion. The striker assembly also includes a striker sleeve having a wall that has an inner surface defining an interior space having first and second openings. The wall has corrugations such that the inner surface defines a plurality of concave portions and joining portions that interconnect the concave portions. The concave portions and the joining portions extend from the first opening to the second opening. The shaft portion is inside the interior space and the outer surface of the shaft portion contacts the joining portions of the inner surface of the striker sleeve.

15 Claims, 3 Drawing Sheets

(56) References Cited

U.S. PATENT DOCUMENTS

| | | | | | |
|---|---|---|---|---|---|
| 3,680,902 | A | * | 8/1972 | Slattery | 292/341.14 |
| 4,357,039 | A | * | 11/1982 | Tolle | 292/341.12 |
| 6,073,980 | A | * | 6/2000 | Arabia et al. | 292/340 |
| 6,095,576 | A | * | 8/2000 | Burton | 292/340 |
| 6,106,037 | A | * | 8/2000 | Burton | 292/340 |
| 6,267,421 | B1 | * | 7/2001 | Burton | 292/340 |
| 2012/0274091 | A1 | * | 11/2012 | Yue | 296/100.04 |

* cited by examiner

STRIKER WITH EXPANDABLE SLEEVE

CROSS-REFERENCE TO RELATED APPLICATION

This application claims the benefit of U.S. Provisional Patent Application No. 61/768,867, filed Feb. 25, 2013, and which is hereby incorporated by reference in its entirety.

TECHNICAL FIELD

This invention relates to vehicle door latching systems and more particularly to a striker assembly having a protective sleeve.

BACKGROUND

Automotive vehicles are typically equipped with a door latch in each door. The latch engages a striker shaft that is secured to a vehicle door jamb pillar. The latch, particularly one for a swinging door, has a fishmouth slot that opens toward the vehicle interior and extends through a cutout in the face plate of the latch. This fishmouth slot guides the striker shaft into the interior of the door latch as the vehicle door is closed.

As the striker shaft travels into the fishmouth slot, it "strikes" or engages an internal, pivotally mounted fork bolt lever that is part of a latching mechanism. The striker shaft then rotates the fork bolt lever to a latched position where a portion of the fork bolt lever wraps around the striker shaft and closes off the fishmouth slot. The fork bolt lever is typically held in the latched position by a detent lever or pawl that is released by a door handle when the door is opened.

SUMMARY

A striker assembly includes a striker sleeve and a striker. The striker has an attachment portion, a shaft portion having a cylindrical outer surface, and a shoulder portion between the shaft portion and the attachment portion. The striker sleeve has a wall that has an inner surface defining an interior space. The wall also defines first and second openings to the interior space at opposite ends of the sleeve. The wall has corrugations such that the inner surface defines a plurality of alternating concave portions and joining portions (which interconnect the concave portions). The concave portions and the joining portions extend from the first opening to the second opening. The shaft portion is inside the interior space, and the outer surface of the shaft portion contacts the joining portions of the inner surface of the striker sleeve.

The sleeve provided herein facilitates the use of a highly durable and abrasion resistant material with low expansion properties to form the sleeve because the corrugations in the sleeve facilitate the installation of the sleeve on the shaft portion of the striker. More specifically, the corrugations permit the sleeve to elastically expand (i.e., without plastic or permanent deformation) as it is pushed over the larger diameter shoulder portion, and then spring back to its intended (i.e., unstressed) diameter once it is in place over the shaft portion. The corrugations also provide energy damping when the striker engages the fork bolt of a latch.

A method of assembling the striker is also provided.

The above features and advantages and other features and advantages of the present invention are readily apparent from the following detailed description of the best modes for carrying out the invention when taken in connection with the accompanying drawings.

DETAILED DESCRIPTION

Figure 1:
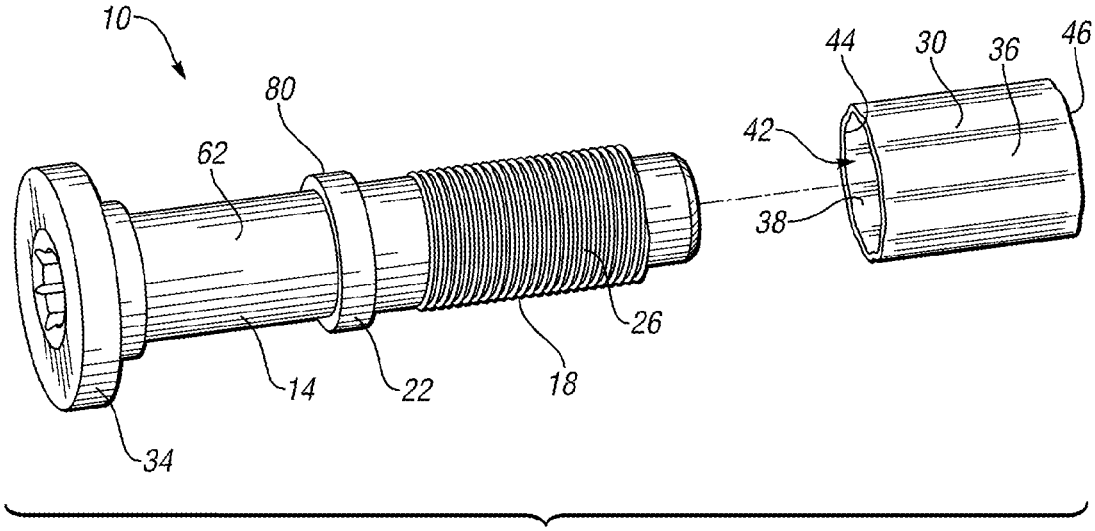
FIG. 1 is a schematic, perspective, exploded view of a striker assembly including a striker and a striker sleeve.

Referring to FIG. 1, a striker 10 (also sometimes referred to as a "striker bolt") for an automotive vehicle body is schematically depicted. The striker 10 is mountable to a door jamb pillar (not shown) of the vehicle body such that, as a door is moved to its closed position, the latch on the door engages the striker 10, thereby retaining the door in its closed position until a user releases the latch. The striker 10 includes a cylindrical shaft portion 14, an attachment portion 18, and a cylindrical shoulder portion 22 between the shaft portion 14 and the attachment portion 18.

The attachment portion 18 is the portion of the striker bolt 10 used to attach the striker bolt 10 to a vehicle body. The attachment portion 18 will typically be inserted through a hole in the door jamb to secure the striker 10 to the vehicle body. For example, in the embodiment depicted, the attachment portion 18 is a threaded bolt portion that has external threads 26. The threaded bolt portion extends through a hole in the doorjamb, and the threads 26 engage with the internal threads of a nut (not shown) on the opposite side of the door jamb pillar to mount the striker 10 to the door jamb pillar such that the shaft portion 14 is exposed in the body opening and can mate with the latch when the door is closed.

It should be noted that the attachment portion 18 may have other configurations within the scope of the claims. For example, the attachment portion 18 may be an unthreaded tenon that is flattened (and thereby widened) by peening after the tenon is inserted though the hole in the door jamb. The shoulder portion 22 has a larger diameter than the attachment portion 18 and the shaft portion 14; the larger diameter of the shoulder portion 22 prevents over-insertion of the striker 10 through the hole in the door jamb pillar (i.e., the diameter of the shoulder portion 22 is larger than the hole in the door jamb pillar).

A polymeric striker sleeve 30 is employed to cover the cylindrical outer surface of the shaft portion 14 and thereby reduce sound generated when the latch contacts the striker shaft portion 14 during door closing. The striker 10 includes a cap portion 34 at the end of the shaft portion 14; the cap portion 34 is generally cylindrical and has a diameter greater than the diameter of the shaft portion 14. The large diameter of the cap portion 34 prevents the removal of the sleeve 30 from the shaft portion 14.

Figure 2:
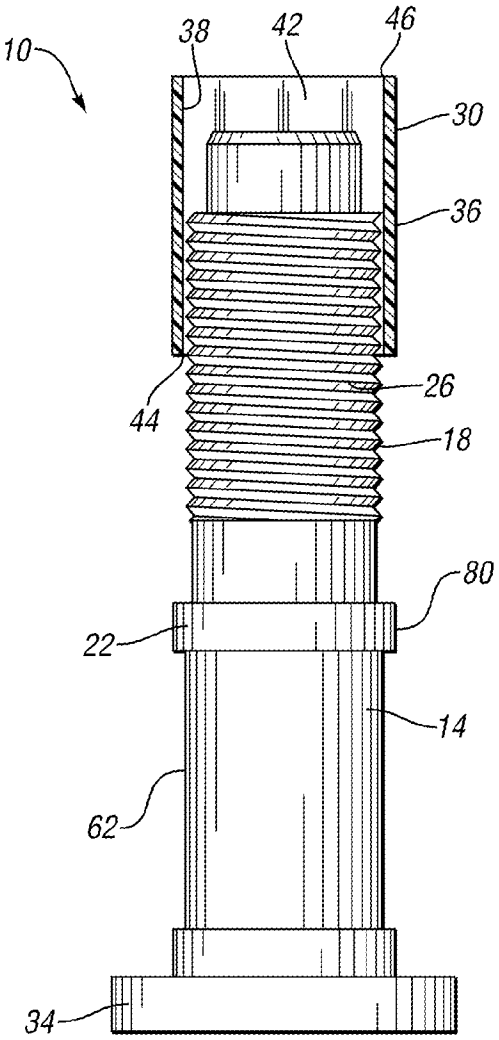
FIG. 2 is a schematic, side view of the striker with the sleeve being installed over an attachment portion of the striker.
Figure 3:
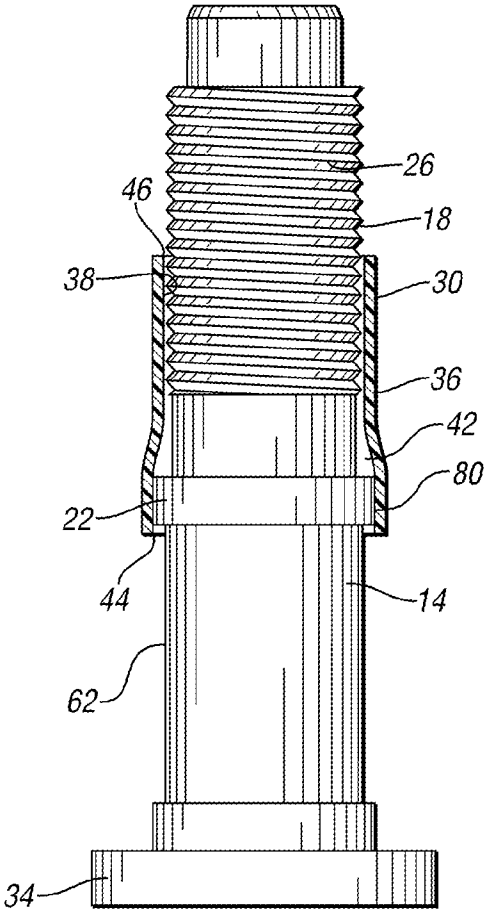
FIG. 3 is a schematic, side view of the striker with the sleeve being installed over a shoulder portion of the striker.
Figure 4:
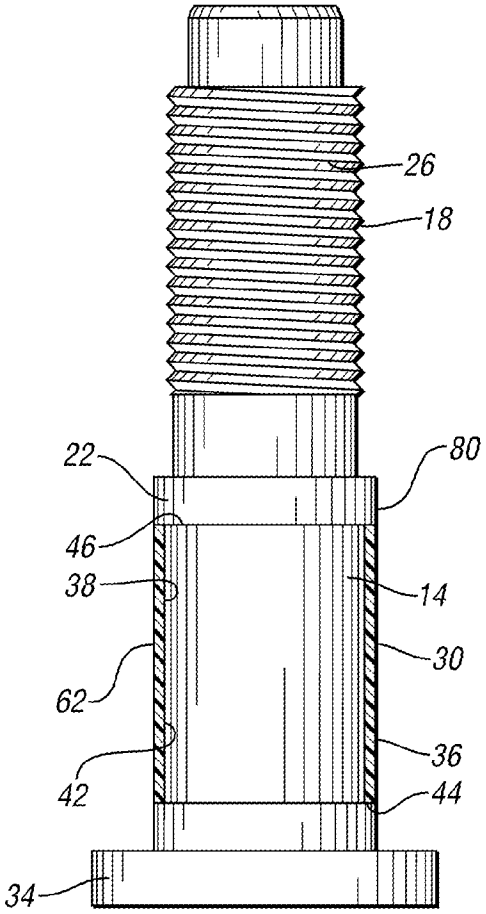
FIG. 4 is a schematic, side view of the striker with the sleeve in its final, installed position over a shaft portion of the striker.

The sleeve 30 includes a wall 36 that is approximately cylindrical, having an inner surface 38 that defines an interior space 42 having first and second openings 44, 46. FIGS. 2-4 schematically depict a method of installing the sleeve 30 on the striker bolt 10, and, more particularly, installing the sleeve 30 around the shaft portion 14. Referring to FIGS. 2-4, the attachment portion 18 is first inserted through one of the openings 44 and through the interior space 42, as shown in FIG. 2. The striker 10 is moved relative to the sleeve 30 until the shaft portion 14 is inside the interior space 42 of the sleeve 30, as shown in FIG. 4. FIG. 4 shows the sleeve 30 in its final, installed position relative to the striker 10.

However, for the sleeve 30 to go from the position shown in FIG. 2 to the position shown in FIG. 4, the shoulder portion 22 must go through the interior space 42. However, the diameter of the shoulder portion 22 is greater than the size of the openings 44, 46 and the interior space 42. Accordingly, the sleeve 30 must be expanded to accommodate the shoulder portion 22, as shown in FIG. 3. The sleeve 30 is comprised of a hard plastic, such as a polyamide (PA 66 or PA46) to resist wear, and so sufficiently deforming the sleeve 30 to accommodate the shoulder portion 22 may not be possible with a prior art sleeve.

Figure 5:
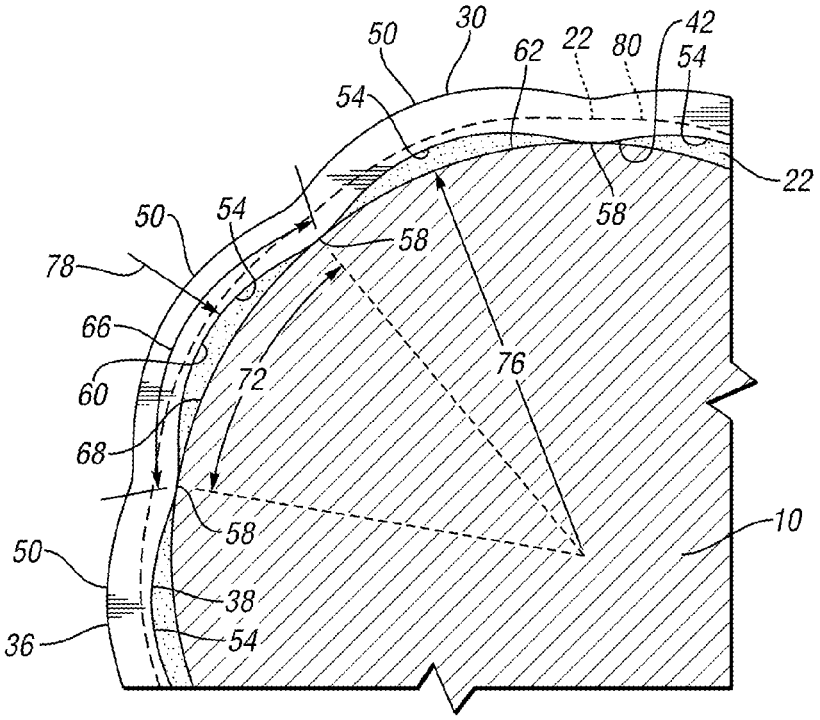
FIG. 5 is a schematic, sectional view of a segment of the shaft portion of the striker inside the sleeve.

Referring to FIG. 5, the wall 36 of the sleeve 30 has corrugations 50 such that the inner surface 38 defines a plurality of concave portions 54 and convex joining portions 58 that interconnect the concave portions 54; that is, the concave portions 54 and the joining portions 58 are alternating around the inner surface 38, and each joining portion 58 is between, and connects or joins, two of the concave portions 54. The concave portions 54 and the joining portions 58 extend from the first opening 44 to the second opening 46, and thus the concave portions 54 forms grooves or furrows in the inner surface 38 that are longitudinally oriented. In the embodiment depicted, each concave portion 54 forms a respective sleeve arc 60 (in cross-section); each of sleeve arc 60 intersects with an adjacent sleeve arc at one of the joining portions 58. In the embodiment depicted, there are nine concave portions 54 evenly-spaced from one another around the circumference of the wall 36, though other quantities and sizes of concave portions may be employed within the scope of the claims.

Figure 7:
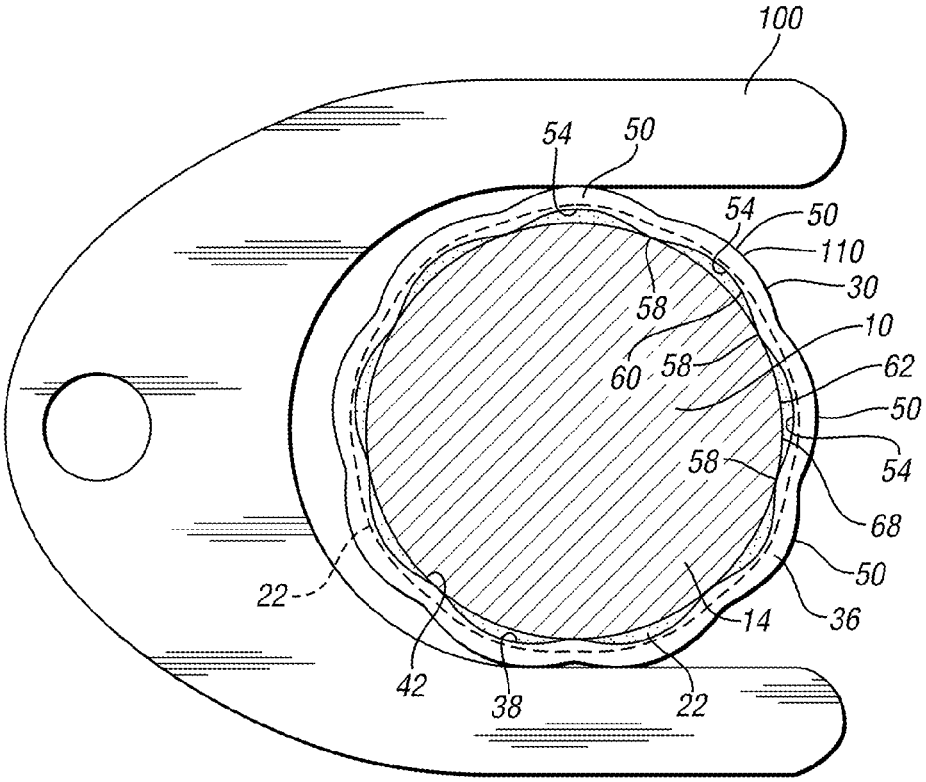
FIG. 7 is a schematic, sectional view of the shaft portion of the striker in the sleeve, and the outer surface of the sleeve engaged with a fork bolt lever of a door latch.

FIGS. 5 and 7 depict the shaft portion 14 inside the interior space 42 (i.e., the final, installed position of the sleeve 30 relative to the striker 10 as shown in FIG. 4); the sleeve 30 is sized such that the outer surface 62 of the shaft portion 14 contacts the joining portions 58 of the inner surface 38 of the striker sleeve 30. The shoulder portion 22 has a larger diameter than the shaft portion 14 and the attachment portion 18. The corrugations 50 in the wall 36 of the striker sleeve 30 are sufficiently elastically deformable to enable the shoulder portion 22 to pass through the interior space 42.

More specifically, and with reference to FIG. 5, the sleeve arcs 60 formed by the corrugations 50 have a sleeve arc length 66 when the sleeve 30 is unstressed. The outer surface 62 of the shaft portion 14 forms outer surface arcs 68 in the spaces between the joining portions 58; these outer surface arcs 68 have an outer surface arc length 72 that is less than the sleeve arc length 66. In the embodiment depicted, sleeve arc length 66 is 3.96 millimeters and outer surface arc length 72 is 3.73 millimeters. The radius 76 of the outer surface arc is 5.34 mm in the embodiment depicted, and the radius 78 of the sleeve arc is 2.68 mm in the embodiment depicted.

Figure 6:
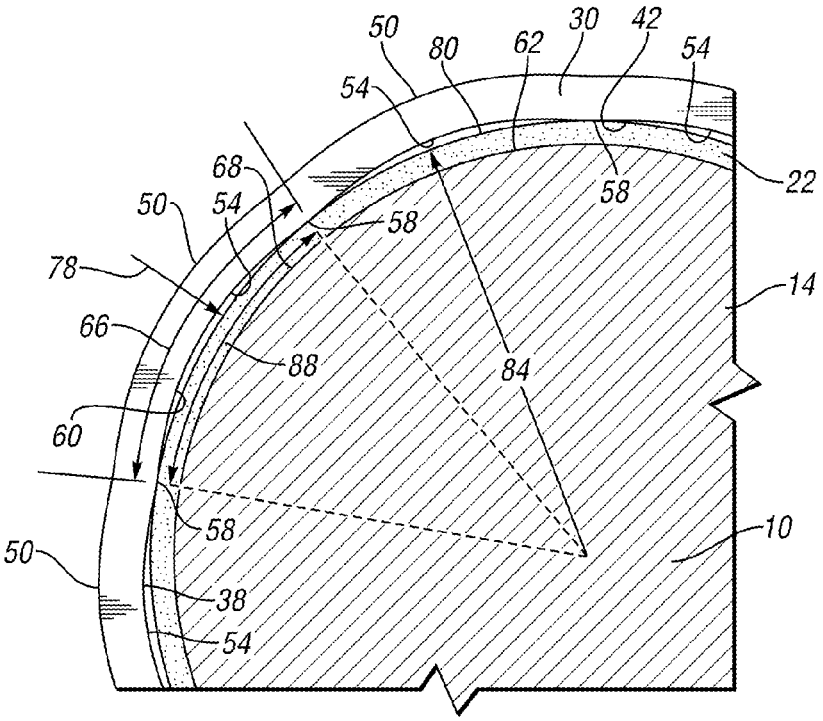
FIG. 6 is a schematic, sectional view of a segment of the shoulder portion inside the sleeve as the sleeve is being installed.

FIG. 6 schematically depicts the shoulder portion 22 inside the interior space 42 of the sleeve 30, which is the intermediate position of the sleeve 30 relative to the striker 10 shown in FIG. 3. Referring to FIG. 6, as a result of the sleeve arc length 66 being greater than the outer surface arc length (shown at 72 in FIG. 5), when the sleeve 30 elastically flexes as the sleeve 30 is pushed over the larger diameter shoulder portion 22 (as seen in FIG. 6), the corrugations 50 flatten out and effectively increase the inside circumference of the sleeve 30 as well as the inside radius of the sleeve 30. That is, the sleeve 30 is configured such that, when the shoulder portion 22 is inside the interior space 42, the outer surface 80 of the shoulder portion 22 exerts a radially-outward force on the joining portions 58 of the inner surface 38 of the sleeve 30 such that the radius 78 of the sleeve arcs 60 increases relative to when the shoulder portion 22 is not in the interior space 42.

In the expanded state seen in FIG. 6, the sleeve arc length 66 is the same as in FIG. 5, but the radius 78 of the arc 60 has increased from 2.68 mm to 4.36 mm. The radius 84 of the shoulder portion 22 in the embodiment depicted is 5.62 mm. The arc length 88 of the outer surface 80 of the shoulder portion 22 between joining portions 58 is less than the sleeve arc length 66. In the embodiment depicted, the arc length 88 is 3.92 mm, which is less than arc length 66 of 3.96 mm.

The corrugations 50 enable the deformation of the sleeve 30 by the shoulder portion 22 to be entirely elastic (i.e., without plastic deformation); when the sleeve 30 traverses the shoulder portion 22 and rests on the shaft portion 14, the deformation is reversed. It should be noted that the specific dimensions provided herein describe one particular embodiment, and are not to be construed as limiting the scope of the claims.

Referring to FIG. 7, the striker 10 is shown with the fork bolt lever 100 of the latch contacting and engaged with the outer surface 110 of the sleeve 30 as it surrounds the shaft portion 14. The corrugations 50 provide a dampening feature when the latch mechanism is engaged to the striker, which takes up all clearances and produces a very quiet and dampened joint. Thus, in addition to improving sleeve durability by allowing the use of highly durable and abrasion resistant materials which otherwise could not be used, the sleeve 30 provides greater sound attenuation since the corrugations 50 act as compressible springs to cushion the interface between the striker bolt 10 and the fork bolt 100 of the latch mechanism.

While the best modes for carrying out the invention have been described in detail, those familiar with the art to which this invention relates will recognize various alternative designs and embodiments for practicing the invention within the scope of the appended claims.

The invention claimed is:

1. A striker assembly comprising:

a striker having an attachment portion, a shaft portion having a cylindrical outer surface, and a shoulder portion between the shaft portion and the attachment portion;

a striker sleeve having a wall that has an inner surface defining an interior space having first and second openings, the wall having corrugations such that the inner surface defines a plurality of concave portions and joining portions that interconnect the concave portions, the concave portions and the joining portions extending from the first opening to the second opening;

wherein the shaft portion of the striker is inside the interior space of the striker sleeve and the outer surface of the shaft portion contacts the joining portions of the inner surface of the striker sleeve;

wherein the shoulder portion has an outer diameter which is larger than outer diameters of the shaft portion and the attachment portion; and wherein the corrugations in the wall of the striker sleeve are sufficiently elastically deformable to enable the shoulder portion to pass through the interior space.

2. The striker assembly of claim 1, wherein each of the concave portions forms a respective sleeve arc having a sleeve arc length and a radius; and wherein the outer surface of the shaft portion forms outer surface arcs between the joining portions, the outer surface arcs having an outer surface arc length that is less than the sleeve arc length.

3. The striker assembly of claim 2, wherein a radius of the shaft portion is greater than the radius of the sleeve arcs.

4. The striker assembly of claim 3, wherein the sleeve is configured such that, when the shoulder portion is inside the interior space, the outer surface of the shoulder portion exerts a radially-outward force on the joining portions of the inner surface of the sleeve such that the radius of the sleeve arcs increases to an expanded radius; and wherein the radius of the shoulder portion is greater than the expanded radius.

5. The striker assembly of claim 1, wherein the sleeve comprises a polymer.

6. The striker assembly of claim 5, wherein the polymer is a polyamide.

7. The striker assembly of claim 6, wherein the polyamide is one of PA 46 and PA 66.

8. The striker assembly of claim 1, wherein the joining portions are convex.

9. A method of assembling a striker assembly comprising:

providing a striker having an attachment portion, a shaft portion having a cylindrical outer surface, and a shoulder portion between the shaft portion and the attachment portion, the shoulder portion having an outer diameter which is larger than outer diameters of the shaft portion and the attachment portion;

providing a striker sleeve having a wall that has an inner surface defining an interior space having first and second openings, the wall having corrugations such that the inner surface defines a plurality of concave portions and joining portions that interconnect the concave portions, the concave portions and the joining portions extending from the first opening to the second opening; and moving the striker relative to the sleeve until the shaft portion is inside the interior space of the sleeve;

wherein moving the striker relative to the sleeve includes:

inserting the attachment portion through the first and second openings and through the interior space; and moving the shoulder portion through the interior space of the sleeve such that the shoulder portion elastically deforms the corrugations of the wall; and continuing to move the striker relative to the sleeve until the sleeve surrounds the shaft portion and the joining portions of the inner surface contact the outer surface of the shaft portion;

wherein the sleeve is not plastically deformed during movement of the striker relative to the sleeve.

10. The method of claim 9, wherein the sleeve comprises a polymer.

11. The method of claim 10, wherein the polymer is a polyamide.

12. The method of claim 11, wherein the polyamide is one of PA 46 and PA 6.

13. The method of claim 9, wherein each of the concave portions forms a respective sleeve arc having a sleeve arc radius which is expanded to an expanded sleeve arc radius during movement of the shoulder portion through the interior space of the sleeve; and wherein the expanded sleeve arc radius is less than a radius of the shoulder portion.

14. The method of claim 9, wherein an outer diameter of the sleeve is substantially the same as the outer diameter of the shoulder portion.

15. The striker assembly of claim 1, further comprising:

wherein the wall has an outside surface having an outer diameter defined by the plurality of concave portions; and wherein the outer diameter of the wall is substantially the same as the outer diameter of the shoulder portion.

* * * * *